United States Patent [19]

Krause et al.

[11] Patent Number: 4,574,277

[45] Date of Patent: Mar. 4, 1986

[54] SELECTIVE PAGE DISABLE FOR A VIDEO DISPLAY

[75] Inventors: Charles A. Krause, Stevensville; Babu Rajaram, St. Joseph, both of Mich.

[73] Assignee: Zenith Radio Corporation, Glenview, Ill.

[21] Appl. No.: 527,944

[22] Filed: Aug. 30, 1983

[51] Int. Cl.[4] ..... G09G 1/28

[52] U.S. Cl. ..... 340/703; 340/723; 340/798

[58] Field of Search ..... 340/703, 723, 724, 725, 340/798, 799, 793, 701, 721

[56] References Cited

U.S. PATENT DOCUMENTS

| | | | |
|---|---|---|---|
| 4,149,184 | 4/1979 | Giddings et al. | 340/703 |
| 4,225,861 | 9/1980 | Langdon, Jr. et al. | 340/703 |
| 4,342,029 | 7/1982 | Hofmanis et al. | 340/799 |
| 4,386,410 | 5/1983 | Pandya et al. | 340/726 |
| 4,467,322 | 8/1984 | Bell et al. | 340/701 |
| 4,481,594 | 11/1984 | Staggs et al. | 340/701 |
| 4,484,187 | 11/1984 | Brown et al. | 340/723 |
| 4,500,875 | 2/1985 | Schmitz | 340/723 |

*Primary Examiner*—Gerald L. Brigance

[57] ABSTRACT

A video display system utilizes three banks of memory for producing an 8-color or an 8-level gray scale display. A separate memory plane, or random access memory (RAM) array, for each of the "primary" video colors, i.e., red, green and blue, is used in a bit-mapped video graphics implementation for a computer driven video display. In a monochrome display, pixel mixing produces the 8-level gray scale display. Each of the video planes may be selectively disabled as desired for special applications. For example, a limited animation capability may be provided by displaying one page while generating a new page in a non-displayed page. By disabling the currently displayed plane as the new plane is enabled, instantaneous page modification may be closely simulated for animated applications. The thus disabled video plane may then be used as any normal page of RAM for any other application. In addition, all of the video RAM planes may be disengaged from the central processing unit (CPU) to blank the video display for various applications such as during initial system reset or as part of an operating program.

11 Claims, 2 Drawing Figures

SELECTIVE PAGE DISABLE FOR A VIDEO DISPLAY

CROSS-REFERENCE TO RELATED APPLICATION

This application is related to but in no way dependent upon the following application which is assigned to the assignee of the present application: Ser. No. 446,296, filed Mar. 21, 1983, entitled "Video Ram Accessing System", in the name of Babu Rajaram and issued as U.S. Pat. No. 4,511,965 on Apr. 16, 1985.

BACKGROUND OF THE INVENTION

This invention relates generally to computer controlled video displays and is particularly directed to a bit-mapped video graphics system in which a separate plane, or RAM array, is used for presentation of either the primary colors in a color display or various shades of gray in a monochrome display.

In general, a video display system utilizing a cathode ray tube (CRT) provides discrete picture elements for presentation of symbols and a display memory for storage of digital signals representative of picture elements of the video display. These systems further include a computer having a program memory for receiving digital input signals and providing data signals and other digital output signals representing picture elements in response to various input signals. A video processor, or controller, is typically connected to the computer and display memory for selectively modifying the picture element output signals from the computer in response to the output data signals and for transferring the thus modified picture element signals to the display memory. The video processor is also coupled to the CRT display for providing signals thereto in response to the digital picture information stored in the display memory whereby the picture elements represented therein are displayed.

Each frame of the picture displayed on a CRT is comprised of a plurality of picture elements termed pixels which are rapidly and sequentially displayed in the raster scan of the video display's faceplate. A random access memory (RAM) may store digital data representative of each picture element to be displayed on the screen. The digital data stored in the RAM is read synchronously therefrom with the raster scanning of the picture elements of the video display. This digital data is converted to signals for driving the CRT in defining the particular pixels being displayed. A microcomputer which includes a programmed central processing unit (CPU), or microprocessor, may be used to update or modify the data stored in the RAM and to modify the picture presented on the video display in response to signals transmitted from user initiated control inputs in accordance with the microprocessor's program.

In many prior art microcomputer controlled displays, color information is stored as three digital bits which are used to designate green, red and blue. A fourth bit for providing high/low intensity control is also sometimes provided. Prior art video displays have generally provided the capability to blank the monitor under certain operating conditions, as desired. For example, during a system reset operation, the video display is typically blank in order to avoid displaying uninitialized memory at power-up or system reset. This permits the video display's read only memory (ROM), in which is stored a suitable operating program and a desired assembler or compiler, to clear the system's memory before enabling the video RAM in which is stored video display mapping information.

In certain circumstances it may be desirable to selectively inhibit a portion of memory dedicated to one or more of the aforementioned primary colors. For example, in displaying graphic information it is frequently necessary to display different parameters or sets of data in different colors and to individually and/or in combination present this information in order to facilitate distinguishing one set of data from another. In addition, some applications may require the sequential presentation of various display scenes or formats in a continuous manner. Prior art video display systems which have afforded these capabilities have generally required large dedicated memories and are consequently rather complicated and expensive.

The present invention is intended to overcome the aforementioned limitations of the prior art by providing a computer controlled video display system in which each of the three video memory planes, each dedicated to a primary color, may be selectively disabled as desired. When disabled, a video plane may be used as any normal page of RAM for any other application providing the system with an expanded memory capacity when one of the video planes is disabled as well as an enhanced display capability when all video planes are utilized.

OBJECTS OF THE INVENTION

Accordingly, it is an object of the present invention to provide an improved color graphics arrangement for a video display system.

It is another object of the present invention to provide for the selective disabling of each of the color planes in a video display.

Yet another object of the present invention is to provide more efficient use of a video RAM array in a computer controlled color video display.

Still another object of the present invention is to provide a low cost animation capability in a computer controlled video display.

BRIEF DESCRIPTION OF THE DRAWINGS

The appended claims set forth those novel features which characterize of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
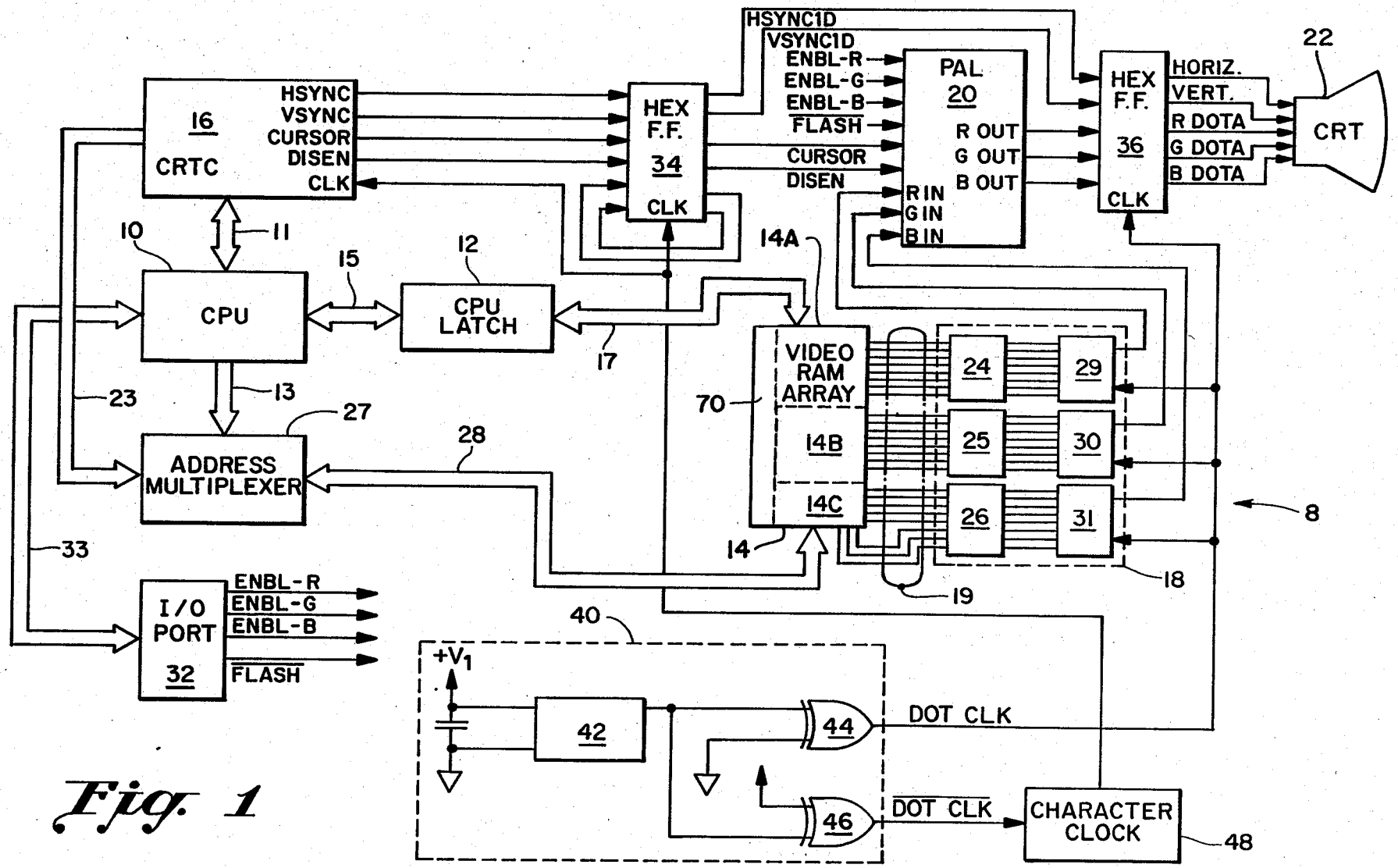
FIG. 1 is a simplified block diagram showing a selective page disable system for a video display in accordance with the present invention.

Referring to FIG. 1. there is shown in simplified block diagram form a selective page disable system 8 for a video display in accordance with the present invention. User initiated inputs are provided to a central processing unit (CPU) 10 by means of a conventional input device such as a keyboard (not shown). The microprocessor utilized in the preferred embodiment of the present invention is the 8-bit HMOS 8088 microprocessor available from Intel Corporation of Santa Clara, Calif. This microprocessor includes an 8-bit data bus interface which can address up to a maximum of 1 megabyte of memory. The 8088 microprocessor is conventional in design and operation and thus representative of the typical 8-bit microprocessor currently available. However, the present invention is not limited in its application to the use of the 8088 microprocessor, nor is it limited in operation to an 8-bit microprocessor, but will operate equally well with any conventional microprocessor regardless of word length.

CPU 10 is coupled to a video RAM array 14 via a data bus 13, an address multiplexer 27 and an address bus 28 as well as via data IN bus 15, a CPU latch circuit 12 and a data OUT bus 17. CPU 10 is capable of either writing data into or reading data from the video RAM array 14. Similarly, a cathode ray tube controller (CRTC) 16 is coupled to the video RAM array 14 via a CRT controller address bus 23, address multiplexer 27 and address bus 28. Unlike CPU 10, CRT controller 16 is only capable of providing addresses to the video RAM array 14 so that video information may be read therefrom. The address multiplexer 27 is also connected to an arbitration logic unit (not shown) which performs a switching function in selectively coupling the CPU 10 to the video RAM array 14 between successive CRT controller access periods. The manner in which this selective accessing of the video RAM array 14 b CPU 10 and CRT controller 16 is described and claimed in a related co-pending application entitled "Video RAM Accessing System", Ser. No. 446,296, filed Mar. 21, 1983, in the name of Babu Rajaram, and issued as U.S. Pat. No. 4,511,965 on Apr. 16, 1985 which is hereby incorporated by reference herein. Since the manner in which CPU 10 and CRT controller 16 access is provided to the video RAM array 14 does not form a part of the present invention, it is not further described herein.

The video RAM array 14 utilized in a preferred embodiment of the present invention is a "half good" 64K random access memory (RAM). This type of RAM is generally inexpensive since it possesses something less than 64K memory capacity and is readily available at slower operating speeds. The CRT controller 16 provides address information to the video RAM array 14, with the contents thereof then provided via data OUT bus 19 to a video latch 18. Similarly, the contents of the video RAM array may be selectively provided via data OUT bus 17 to a CPU latch 12 in accordance with control instructions provided to the video RAM array 14 by CPU 10. In this manner, the contents of the video RAM array may be read by the CPU 10 via the data OUT bus 17, CPU latch 12 and a CPU data IN bus 15. The CPU 10 may then, after reading the data contents of the video RAM array 14, make system control decisions in accordance with program instructions stored therein.

CPU latch 12 and video latch 18 are 8-bit latches and provide parallel IN/parallel OUT processing of the bits in converting the stored contents of the video RAM array 14 into a signal form representing the actual dots, or pixels, on the face of a CRT 22 for the selective illumination thereof in displaying video information thereon. The parallel output of the video latch 18 is provided to video logic circuitry 20 where it is converted to a serial bit stream and provided via a hex D-type flip-flop circuit 36, and thence to CRT 22 in synchronism with the raster scanning thereof.

A bi-directional data/control bus 11 couples the CPU 10 with the CRT controller 16. Thus, under the direction of CPU 10, the CRT controller 16 selectively reads the contents of the video RAM array 14 in providing appropriate data inputs via the data OUT bus 19 to the combination of video latch 18 and video logic circuit 20 in driving the CRT 22.

The CRT controller 16 utilized in a preferred embodiment of the present invention is the HD 6845 CRT controller available from Hitachi America, Ltd. In selectively reading the contents of the video RAM array 14 under the control of the CPU 10, the CRT controller 16 provides for the appropriate 8-bit output signals to the video latch 18 via the data OUT bus 19. The CRT controller 16 continuously updates the CRT's screen 60 times per second based upon the contents of the addressed locations in the video RAM array 14. The CRT controller 16 generates a video RAM address signal and reads a byte representing 8 pixels on the CRT's screen from the video RAM array 14. Once these pixels are displayed, the CRT controller 16 automatically, depending upon its initialization parameters, advances to the next byte describing the next group of pixels with this process continuing without interruption.

The control/data signals transmitted via CPU data/control bus 11 connecting the CPU 10 and the CRT controller 16 specify such system parameters as CRT type, lines per screen to be displayed on the CRT, characters per line and interrupt generation during the vertical sync interval. From FIG. 1, it can be seen that control and data signals are provided between the video RAM array 14 and both the CPU 10 and the CRT controller 16.

A DOT clock 40 comprised of an oscillator circuit 42 and exclusive OR gates 44, 46 is provided for selectively turning on the electron beam of the CRT 22 and illuminating predetermined dots, or pixels, on the CRT's screen. The oscillator circuit 42 is coupled to a $+V_1$ direct voltage source and oscillates at a frequency of 14.112 MHz in a preferred embodiment. The oscillator circuit 42 thus provides timing input signals to exclusive OR gate 44, the other input to which is grounded, and to exclusive OR gate 46, the other input to which is pulled high, in generating respectively a noninverted clock signal (DOTCLK) and an inverted clock signal ($\overline{\text{DOTCLK}}$). This arrangement provides for minimum skew between the two aforementioned clock signals. The noninverted clock signal DOTCLK is provided to the clock inputs of red, green and blue shift registers 29, 30 and 31 in the video latch 18. The noninverted clock signal DOTCLK is also provided to the clock input of the hex D-type flip-flop 36 which couples the hex D-type flip-flop 34 and the video logic circuit 20 to the CRT 22. The inverted clock signal DOTCLK is provided to a character clock circuit 48, the timed output of which is provided to the hex D-type flip-flop circuit 34. The character clock 48 includes a plurality of quad registers (not shown) for counting 8 DOTCLK periods which comprises a single character clock period. The character clock output signal is also provided to the clock input of the CRT controller 16 for synchronizing horizontal and vertical sweep with the display of characters on the CRT 22. HSYNC and VSYNC signals provided from CRT controller 16 to hex D-type flip-flop circuit 34 insure that the first displayed dot occurs at the first character location on the faceplate of CRT 22. Flip-flop circuit 34 provides a delay in the HSYNC and VSYNC signals in generating delayed timing signals, HSYNCID and VSYNCID, for hex D-type flip-flop circuit 36 for synchronizing character clock periods with the 8-bit dot signals provided from video logic circuit 20 via HEX flip-flop circuit 36 to CRT 22.

The video RAM array 14 includes three memory banks each 32K×8 bits for respectively storing red, green, and blue color data. The organization of the video RAM array 14 is shown in Table I. Each of the three video planes resides in a distinct 64K byte segment in the video RAM array 14. The green plane is at address EOOOOH, the red plane is at address DOOOOH, and the blue plane is at address COOOOH.

TABLE I

| | | |
|---|---|---|
| FFFFF | 64K | |
| F0000 | | |
| EFFFF | 32K | VIDEO MEMORY |
| E0000 | 32K | |
| DFFFF | 32K | |
| D0000 | 32K | |
| CFFFF | 32K | |
| C0000 | 32K | |
| BFFFF | | |
| B0000 | 64K | OTHER MEMORY |
| AFFFF | 64K | |
| A0000 | | |
| 9FFFF | 64K | |
| 90000 | | |
| 8FFFF | 64K | |
| 80000 | | |
| 7FFFF | 64K | |
| 70000 | | |
| 6FFFF | 64K | |
| 60000 | | |
| 5FFFF | | |
| 50000 | 64K | |
| 4FFFF | 64K | |
| 40000 | | |
| 3FFFF | 64K | |
| 30000 | | |
| 2FFFF | 64K | |
| 20000 | | |
| 1FFFF | 64K | |
| 10000 | | |
| FFFF | 64K | |
| 0 | | |

In a black and white system only the green plane, which is of highest intensity, is utilized. The various combinations of the several color video planes and the resulting colors available are shown in Table II.

TABLE II

| Green | Red | Blue | |
|---|---|---|---|
| 0 | 0 | 0 | Black, i.e. blank pixel |
| 0 | 0 | 1 | Blue |
| 0 | 1 | 0 | Red |
| 0 | 1 | 1 | Magenta |
| 1 | 0 | 0 | Green |
| 1 | 0 | 1 | Cyan |
| 1 | 1 | 0 | Yellow |
| 1 | 1 | 1 | White |

1 means pixel in color plane is on
0 means pixel in color plane is off

The color planes are organized in decreasing order of relative intensity with the highest, i.e., green, at the top of the available memory space. Because the green video RAM plane 14A is used for black and white applications it is positioned in the highest memory space. As described below, an unused green, red or blue video RAM is contiguous with the primary system memory 70 as shown in Table I and in FIG. 1 and may be used for data storage to increase the memory capacity of the present system when less than all of the color video memory planes are utilized.

Under the control of user instructions provided to CPU 10 and in accordance with operating program instructions stored therein, the CRT controller 16 reads graphic information from the video RAM 14 array in providing video data to CRT 22 for display thereon. The CRT controller 16 reads bytes from each of the green, red and blue video RAMs 14A, 14B and 14C, and provides this data to respective latches 24, 25 and 26 in the video latch circuit 18. The latched outputs of latches 24, 25 and 26 are, in turn, provided to green, red and blue shift registers 29, 30 and 31 for serially shifting respective color data into the video logic circuit 20. Latches 24, 25 and 26 insure that data is shifted out of shift registers 29, 30 and 31 before a respective shift register is loaded with the next sequence of color data. Timing for shift registers 29, 30 and 31 is provided by the DOTCLK output of the dot clock circuit 40.

Each character displayed on CRT 22 is defined by an 8×10 pixel matrix. Thus, in a color display, 8-bits are read from each of video RAM banks 14A, 14B and 14C and provided in parallel to red, green, and blue latches 24, 25 and 26. The 8-bit bytes of color video information are then loaded in parallel to respective shift registers 29, 30 and 31. This color information is then serially shifted out of shift registers 29, 30 and 31 in accordance with the DOTCLK signal provided to the respective clock inputs thereof. The thus serially shifted data is then provided as RIN, GIN, and BIN inputs to video logic circuit 20.

When video information from the video RAM array 14 is to be displayed on CRT 22, color enable signals are provided from CPU 10 via data bus 33 to a parallel input/output (I/O) port 32. In response to these color enable signals, I/O port 32 outputs ENBL-R, ENBL-G, and ENBL-B enable signals to the video logic circuit 20 for the display of color video information in accordance with the program being executed by CPU 10. I/O port 32 thus functions as an interface adaptor between CPU 10 and video logic circuit 20 in providing two 8-bit bidirectional peripheral data buses and four control lines between these two devices. In a preferred embodiment, the Motorola MC 68A21 peripheral interface adaptor (PIA) chip is utilized for I/O port 32, while the video logic circuit 20 is comprised of a 14H4 programmable array logic (PAL) integrated circuit (IC) available from National Semiconductor Corporation. This PAL device is comprised of a plurality of AND and OR logic gates for processing the various signals provided thereto in driving CRT 22. The configuration and operation of video logic circuit 20 is described in detail with reference to FIG. 2. In addition to the ENBL-R, ENBL-G, and ENBL-B color enable signals, the I/O port 32 also provides a $\overline{\text{FLASH}}$ output to the video logic circuit 20. When the $\overline{\text{FLASH}}$ output is asserted by I/O port 32, the output lines selected by the respective color enable lines will go high, saturating that color onto the screen and masking any video data on that line as described in detail below.

As described above, timing for the CRT controller 16 is provided by the character clock 48 which, in turn, is driven by the DOTCLK 40. With a timing signal thus provided to its CLK input, CRT controller 16 generates horizontal and vertical synchronization signals (HSYNC and VSYNC). As the electron beams within CRT 22 moved across its faceplate, CRT controller 16 advances an internal register (not shown) which is used to point to the current display character. This address is used to determine the specific character used to refresh the screen at any particular point in time. A second register (not shown) is incremented for each consecutive scan line of the specified character and represents the row address. In addition, the CRT controller 16 generates CURSOR and DISEN outputs for providing a visual indication on CRT 22 where the next character will be displayed and for disabling the CRT 22 during horizontal and vertical retrace, respectively.

The various outputs from CRT controller 16 are provided to the hex D-type flip-flop circuit 34. Flip-flop 34 is clocked by the character clock signal provided to its CLK input. Flip-flop circuit 34 synchronizes the HSYNC, VSYNC, CURSOR, and DISEN outputs from the CRT controller 16 with the character clock timing signal in ensuring that the first displayed dot occurs at the first character location on the faceplate of CRT 22. Flip-flop circuit 34 outputs HSYNC1D and VSYNC1D signals to a second hex D-type flip-flop circuit 36. The HSYNlD and VSYNClD signals represent, respectively, HSYNC and VSYNC signals delayed by flip-flop circuit 34 in order to synchronize the respective synchronization signals with character clock timing. This insures that the first displayed dot occurs at the correct location on the faceplate of CRT 22. The HSYNClD and VSYNClD signals are then synchronized with the DOTCLK signal in flip-flop circuit 36 which is clocked by the output of the dot clock circuit 40. The CURSOR output from the CRT controller 16 is synchronized with the character clock by means of flip-flop circuit 34 so that the CURSOR signal goes active on a character boundary, or at the start of the display of a given character. In addition, flip-flop circuit 34 also serves to synchronize the DISEN output from CRT controller 16 with the character clock to insure that the display is disabled at the end of the display of the last character on a given line. The CURSOR and DISEN signals are wrapped back around flip-flop 34 and thus delayed two clock periods in order to provide a double synchronizing function to eliminate oscillations which may result from signal transitions which occur simultaneously with clock transitions. This prevents transition of the CURSOR and DISEN signals in a direction opposite to that desired due to unwanted oscillations.

Figure 2:
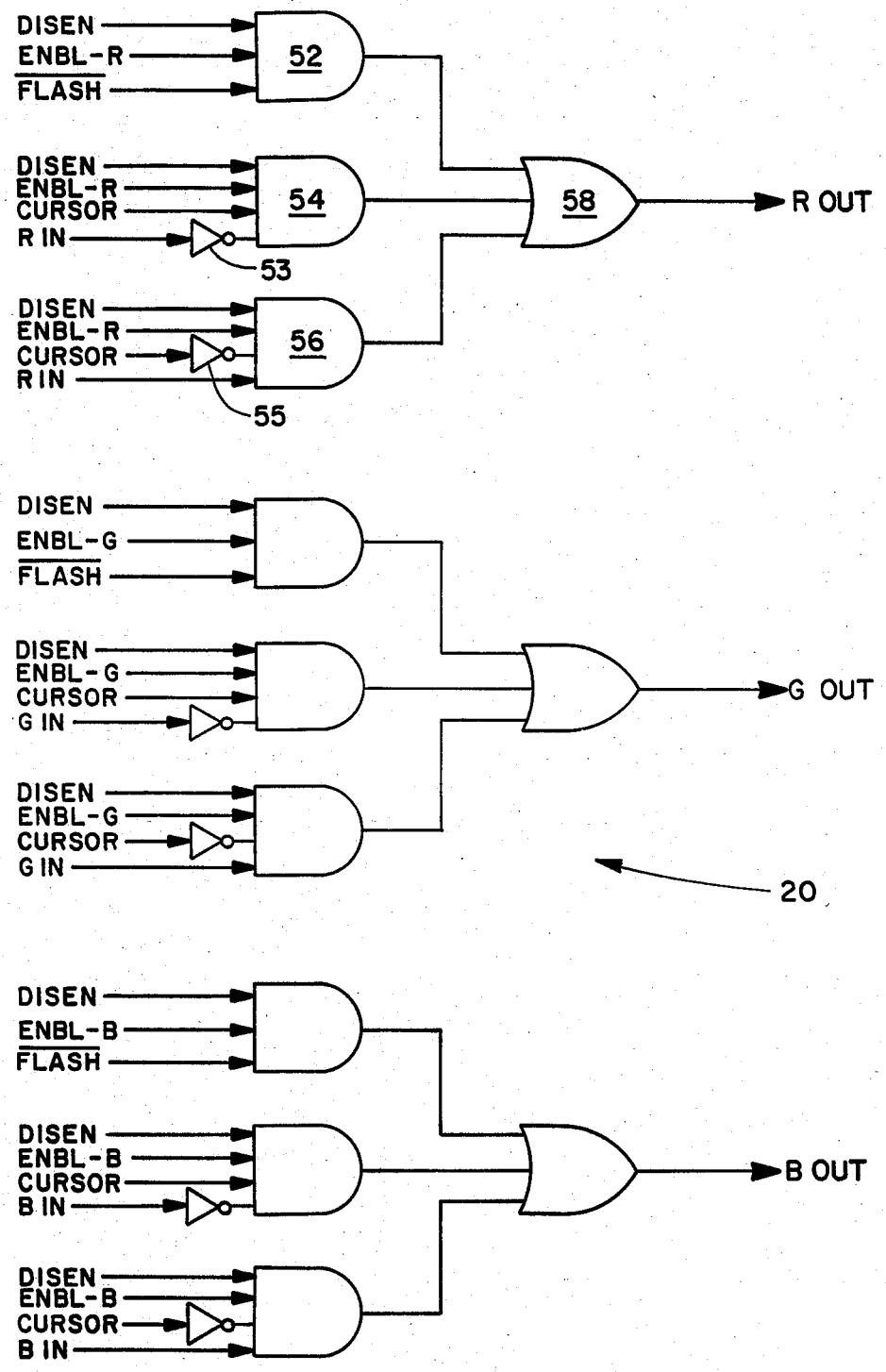
FIG. 2 shows a preferred embodiment of a video logic arrangement for use in the selective page disable system of FIG. 1.

The thus delayed CURSOR and DISEN signals are provided by flip-flop circuit 34 to the video logic circuit 20 to which are also provided the various color enable and control signals as previously described. The configuration of video logic circuit 20 and the various inputs thereto and outputs therefrom are shown in FIG. 2. The operation of video logic circuit 20 will now be explained with respect to the processing of various input signals in generating the color red output signal, ROUT, for display on CRT 22. The generation of the green and blue color signals, GOUT and BOUT, respectively, is similar to the generation of ROUT and will not be described in detail herein.

The generation of the ROUT color signal from video logic circuit 20 representing the red component of a multi-color pixel on CRT 22 will now be explained. This explanation is equally applicable to the generation of GOUT and BOUT color signals as these signals are generated by corresponding input signals processed by similar logic circuitry within video logic circuit 20.

DISEN and ENBL-R inputs are provided to AND gates 52, 54 and 56. As stated earlier, the DISEN signal is output from the CRT controller 16 for disabling the CRT 22 during horizontal and vertical retrace. The ENBL-R signal is received from the I/O port 32 and represents a color enable signal. A $\overline{\text{FLASH}}$ signal is provided to AND gate 52 and a CURSOR signal is provided to AND gate 54 and, via inverter 55, to AND gate 56. Assertion of a $\overline{\text{FLASH}}$ signal results in a saturation of a color onto the CRT's screen, while the CURSOR signal provides a visual indication on CRT 22 of where the next character will be displayed. Similarly, a RIN signal is provided to AND gate 56 and, via inverter 53, to AND gate 54. The various outputs from AND gates 52, 54, 56 are provided to OR gate 58.

In order for the ROUT signal to be generated by OR gate 58 and asserted to hex flip-flop circuit 36 for providing video information from the red video RAM bank 14A for display on CRT 22, OR gate 58 must receive an input signal from any one of AND gates 52, 54 and 56. In order for any of these AND gates to provide an output to OR gate 58, all of the inputs thereto must be asserted. From the inputs provided to AND gates 54 and 56, it can be seen that either one or the other of these AND gates will have an output provided the DISEN and ENBL-R signals as well as CURSOR and/or RIN signals are asserted thereto. Similarly, AND gate 52 will provide an output to OR gate 58 only if all three of the DISEN, ENBL-R and $\overline{\text{FLASH}}$ signals are asserted thereto. Thus, if the cursor is to be displayed, the CURSOR input will be asserted to AND gate 54 as well as the DISEN, ENBL-R and $\overline{\text{RIN}}$ signals with AND gate 54 providing an input to OR gate 58. Similarly, if in the saturation mode of operation, this signal as well as the DISEN and ENBL-R signals will be asserted to AND gate 52 which, in turn, will provide an input to OR gate 58. The third mode of operation is simply the display of color graphic information on the CRT 22 and involves assertion of the DISEN, ENBL-R, $\overline{\text{CURSOR}}$, and RIN inputs to AND gate 56 which, in turn, will provide an input to OR gate 58. In all of the three aforementioned modes of operation, an input signal is provided to OR gate 58 for gating an ROUT color signal to hex flip-flop circuit 36 for displaying the red component of a pixel element on the faceplate of CRT 22.

By selectively providing the corresponding ENBL-G and ENBL-B signals to respective AND gates in the green and blue portions of the video logic circuit 20, GOUT and BOUT signals may be similarly gated to hex flip-flop circuit 36 for displaying one of the primary color components of an individual pixel on the faceplate of CRT 22. From FIG. 2 it can be seen that the processing of the corresponding color enable signals as well as the DISEN, $\overline{\text{FLASH}}$, and CURSOR signals in the green and blue portions of the video logic circuit 20 is similar to that in the red portion thereof. Thus, by selectively controlling the various color enable signals from I/O port 32 in accordance with program instructions stored in CPU 10, each, or all, of the three color video planes may be selectively accessed and displayed on CRT 22.

The DISEN output from the CRT controller 16 is delayed by two character clocks through flip-flop circuit 34. This delay is used to match the timing of the DISEN signal to the video signal delayed by the parallel-in/serial-out converters in the video latch circuit 18. If DISEN is not delayed, retrace blanking will occur two clock cycles early, resulting in the blanking of the last two character positions. The CURSOR signal is similarly delayed by two character clocks in flip-flop circuit 34 for placing the cursor to the right of the last display character. The CURSOR signal generates a cursor at ROUT, GOUT, and BOUT.

The various color outputs ROUT, GOUT, and BOUT are provided from video logic circuit 20 to flip-flop circuit 36. In addition, the delayed synchronization pulses HSYNCID and VSYNCID are provided to hex flip-flop circuit 36. The ROUT, GOUT, and BOUT signals as well as the VSYNCID and HSYNCID timing signals are synchronized with the DOTCLK signal in insuring that the first color dot occurs at the first character location on the faceplate of CRT 22. The thus synchronized HORIZ and VERT sweep signals as well as the RDOTA, GDOTA, and BDOTA color signals are asserted to CRT 22 from flip-flop 36 in synchronization with the occurrence of the DOTCLK timing signal provided to the CLK input of flip-flop circuit 36. Flip-flop circuit 36 corrects for any propagation delays in the various signal paths in providing synchronized sweep and color video signals to CRT 22.

There has thus been shown a selective page disable system for a video display system for selectively disabling individual color memory banks as desired for increased graphics display flexibility. The present invention is applicable to a multi-color video display as well as to a multi-level gray scale display employing a CRT. By disabling the currently enabled color plane as the new plane is enabled, instantaneous page modification may be closely simulated for animated applications.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

we claim:

1. In a raster scanned color video display comprised of a matrix of discrete picture elements, a color control system comprising:

a plurality of memory means each representing a primary color and having a unique storage location for each discrete picture element of said display for the storage of digital memory data signals representative of a respective color component of each of the picture elements of said display;

signal processing means coupled to each of said memory means for reading said digital memory data signals therefrom and for generating a plurality of ENABLE signals each corresponding to a respective one of said memory means in accordance with operating instructions stored in said signal processing means;

control means coupled to said signal processing means and to said plurality of memory means and responsive to said operating instructions for generating timing signals synchronized with the raster scan of said video display; and circuit means coupled to each of said memory means, said signal processing means, said control means and to said video display and responsive to said ENABLE signals generated by said signal processing means for providing said digital memory data signals from each of said memory means to said display means in accordance with operating instructions stored in said signal processing means and in synchronism with said timing signals from said control means wherein the digital memory data signals from one of said memory means is not displayed if a corresponding ENABLE signal is not received from said signal processing means.

2. A color control system as in claim 1 further including a primary system memory contiguous with said plurality of memory means such that when an ENABLE signal corresponding to one of said memory means is not provided to said circuit means by said signal processing means, said one of said memory means may be used in combination with said primary system memory to increase the memory capacity of said color control system.

3. A color control system as in claim 1 wherein said plurality of memory means includes three separate, coupled memory banks each storing digital memory data signals representative of one of three primary colors.

4. A color control system as in claim 3 wherein said three primary colors are red, green and blue.

5. A color control system as in claim 3 wherein each of said memory banks is a random access memory array.

6. A color control system as in claim 1 wherein said circuit means includes a programmable array logic circuit.

7. A color control system as in claim 1 wherein said video display comprises a cathode ray tube.

8. A color control system as in claim 1 wherein a CURSOR signal is generated by said control means and provided to said circuit means for providing a visual indication on said video display of the position of the next matrix of discrete picture elements to be displayed thereon during the raster scanning of said video display.

9. A color control system as in claim 1 wherein a periodic blanking signal is generated by said control means and provided to said circuit means for blanking said video display during horizontal and vertical retrace.

10. A color control system as in claim 1 wherein a high intensity signal is provided to said circuit means from said signal processing means in accordance with said operating instructions for increasing the intensities of those colors for which a corresponding ENABLE signal is asserted so as to prevent the display of said digital memory data signals.

11. A color control system as in claim 1 further comprising a dot clock for providing first timing signals to said circuit means and a character clock coupled to said dot clock and to said control means for providing raster scan timing signal information thereto.

* * * * *